US011389674B2

(12) United States Patent
Koch

(10) Patent No.: US 11,389,674 B2
(45) Date of Patent: Jul. 19, 2022

(54) METHOD AND DEVICE FOR CONNECTING A PROTECTIVE COVER TO A SAFETY COVER SEALED AGAINST THE ENVIRONMENT

(71) Applicant: FLECOTEC AG, Badenweiler (DE)

(72) Inventor: Martin Koch, Neuenburg (DE)

(73) Assignee: FLECOTEC AG, Badenweiler (DE)

( * ) Notice: Subject to any disclaimer, the term of this patent is extended or adjusted under 35 U.S.C. 154(b) by 246 days.

(21) Appl. No.: 16/765,610

(22) PCT Filed: Nov. 19, 2018

(86) PCT No.: PCT/EP2018/081683
§ 371 (c)(1),
(2) Date: May 20, 2020

(87) PCT Pub. No.: WO2019/101664
PCT Pub. Date: May 31, 2019

(65) Prior Publication Data

US 2020/0298030 A1 Sep. 24, 2020

(30) Foreign Application Priority Data

Nov. 21, 2017 (DE) ..... 10 2017 010 737.8

(51) Int. Cl.
*A62B 17/00* (2006.01)
*A41D 13/02* (2006.01)
(Continued)

(52) U.S. Cl.
CPC ..... *A62B 17/006* (2013.01); *A41D 13/02* (2013.01); *A62B 17/001* (2013.01); *B01L 1/02* (2013.01);
(Continued)

(58) Field of Classification Search
CPC .... A61G 10/00; A61G 10/005; A62B 17/006; A62B 17/007; A41D 13/02
See application file for complete search history.

(56) References Cited

U.S. PATENT DOCUMENTS

| | | | |
|---|---|---|---|
| 2,813,022 | A | 11/1957 | Moulthrop |
| 3,355,230 | A | 11/1967 | Trexler |
| 4,302,848 | A | 12/1981 | Otsuka |

FOREIGN PATENT DOCUMENTS

| | | |
|---|---|---|
| DE | 30 13 629 | 10/1980 |
| DE | 89 06 471 | 11/1989 |

(Continued)

OTHER PUBLICATIONS

International Search Report (ISR) dated Mar. 21, 2019 in International (PCT) Application No. PCT/EP2018/081683.

*Primary Examiner* — John P Lacyk
(74) *Attorney, Agent, or Firm* — Wenderoth, Lind & Ponack, L.L.P.

(57) ABSTRACT

A method and a device connects a partially flexible protective cover (2) sealed against the environment and forming a barrier between a contaminated area (12) and an uncontaminated area, to a partially flexible safety cover (20) by transferring the protective cover (2) out of the contaminated area (12) inverting the protective cover (2) over an opening such that its inside is turned out and then severing it from the safety cover (20) and closing the opening; or transferring the protective cover (2) from the contaminated area (12) by sheathing the protective cover (2) with the safety cover (20) as it is pulled through a passage and subsequently severing of both covers (2, 20) from the safety cover (20) and closing the sheathing; or pulling the protective cover (2) back into the contaminated area (12) and then sealing the ends shut to sever the safety cover (20) by forming a further sealed joint between adjacent film parts.

16 Claims, 6 Drawing Sheets

(51) Int. Cl.

| | |
|---|---|
| ***B01L 1/02*** | (2006.01) |
| *G21F 3/025* | (2006.01) |
| *G21F 5/12* | (2006.01) |
| *G21F 7/005* | (2006.01) |
| *A61G 10/00* | (2006.01) |
| *E04B 2/74* | (2006.01) |

(52) U.S. Cl.
CPC .... *A61G 10/005* (2013.01); *E04B 2002/7498* (2013.01); *G21F 3/025* (2013.01); *G21F 5/12* (2013.01); *G21F 7/005* (2013.01)

(56) References Cited

FOREIGN PATENT DOCUMENTS

| | | |
|---|---|---|
| EP | 0 097 514 | 1/1989 |
| JP | 60-599 | 1/1985 |
| WO | 2010/034549 | 4/2010 |

METHOD AND DEVICE FOR CONNECTING A PROTECTIVE COVER TO A SAFETY COVER SEALED AGAINST THE ENVIRONMENT

FIELD OF THE INVENTION

The invention relates to a method for connecting an at least partially flexible protective cover, which forms a barrier between a contaminated area and an uncontaminated area, to an at least partially flexible safety cover sealed against the environment. Furthermore, the invention relates to a device for sealing the connection of a protective cover to a safety cover against the environment, in particular for performing such method.

Such method can be used to transfer a content situated in a protective cover, which is protected against contamination by the protective cover, from a contaminated area to an area protected against contamination, such as a clean room or a manipulator room. The transfer shall be performed in an environmentally sealed manner, i.e. without any risk of contamination of the content inside the protective cover, in particular without the introduction of germs and pathogens, such as viruses. The protective cover may be a coverall for the transfer of a person or a protective packaging for sterile objects, which are secured against contamination by the packaging and which are to be transferred sealed against the environment, i.e. protected, for instance into a manipulator room.

DE 100097514 B1 discloses a process of the type mentioned above. This process provides for a zipper to be used on the docking or transfer area, both on the protective cover, such as a coverall or packaging, and on the safety cover, for instance the enclosure of a protective space, to form an opening permitting the transfer. The zip fasteners are covered by respective sheetings, which sheetings are held in the covering position by interacting hook-and-loop fastener elements. From the covering position, the sheetings can be folded over by pulling the hook-and-loop fastener connection apart such that they can come into binding engagement with the corresponding hook-and-loop fastener parts on the matching other cover and thereby create a sealed connection between the protective cover and the safety cover, after which the transfer opening can be created by opening both zip fasteners.

The connection established by the known method does not provide sufficient protection against contamination. To perform the docking procedure, the covering sheetings of both zippers have to be lifted from the closed position exposing the zipper concerned until the hook-and-loop connection is restored on both covers. Because the respective zipper does not form an environmentally sealed barrier, at this stage of the process the joint is unprotected. Even after the hook-and-loop fastener connection between both covers has been established, protection is insufficient because a connection between the hook-and-loop fastener elements is not completely sealed against the environment.

SUMMARY OF THE INVENTION

Based on this state of the art, the invention addresses the problem of specifying a process of the type mentioned above, permitting a particularly safe connection to be established between the two covers in question, which process also provides protection against microbiological contamination.

Accordingly, the invention provides for at least the following process stages when covers are used, which covers are formed at least partially of a film material, which can be sealed to produce at least one film joint:

a) arranging a receiving end of the safety cover opposite from an end of the protective cover penetrating into the end of the former in a docking area;

b) bringing the ends of the two covers together in the docking area;

c) severing the ends and sealing adjacent film parts of the two covers along a joint seal, which shall delimit the joint seal after a passage opening is opened; and d1) transferring the protective cover out of the contaminated area by inverting the protective cover over the opening such that its inside is turned out and then severing it from the safety cover and closing the opening; or d2) transferring the protective cover out of the contaminated area by sheathing the protective cover with the safety cover as it is pulled through the passage and subsequently severing of both covers from the safety cover and closing the sheathing; or d3) pulling the protective cover back into the contaminated area and then sealing the ends to sever the safety cover by forming a further sealed joint between adjacent film parts.

The docking process is performed in the docking area between the safety cover and the protective cover in accordance with the stages a and b. The docking area, which is preferably located on the outer wall of a protective space or on an airlock chamber of a manipulator room, has a passage for the transfer of the contents of the protective cover to the protective space or airlock chamber. During all process stages a) to d3), the safety cover forms the hermetic seal of this passage. The safety cover is attached to the edge of the passage in the form of a closed, expandable hose, the closed end of which spans the passage over its entire surface before the docking stages a) and b) have been completed. The docking procedure can be performed such that the area of the safety cover forming the receiving end is moved away from the surface, forming a connecting area for the end of the protective cover, into which connecting area this end of the protective cover can penetrate to bring the ends of both covers together in stage b). Corresponding to stage c), the adjacent ends of the two covers are sealed. The sealing operation is a cut and seal process, such that the end parts lying beyond the sealing line are cut off as waste, and such that the sealed joint is manufactured in a peelable manner. An opening then can be formed between the two pairs of films of the protective cover and the safety cover, which are interconnected to transfer the contents of the protective cover to the outside.

This method can be performed in accordance with stage d1) by inverting the protective cover over the opening such that the inside of the protective cover including the contents is turned outwards. Then both the connection area of the safety cover is hermetically sealed again by cutting and sealing, and the unit having the inverted protective cover is severed for disposal. Alternatively, the transfer according to stage d2) can be performed such that the protective cover is sheathed by the safety cover when the safety cover is pulled through the passage. Then both covers are severed from the safety cover while simultaneously closing the sheath. Again, a unit is available for disposal, in which unit a contaminated area is completely closed towards the outside by the surrounding safety cover. In comparison to variant d1), where the inverted protective cover with the non-contaminated inside itself forms the enclosure of the contaminated area, the required film surface area for the safety cover is greater in the variant according to d2). However, this situation is countered by the advantage of a simplified sequence of the process because the inversion process is omitted.

In variant d3) the protective cover is pulled back into the contaminated area and subsequently the ends are sealed to sever the safety cover by forming a further sealed joint between adjacent film parts. This variant results in the advantage that the contaminated covers, the safety cover and the protective cover are returned from the uncontaminated area into the contaminated area and can remain there.

When performing the procedure according to variant d1), a contaminated area is enclosed inside the inverted protective cover thereby closing the passage opening. In the procedure according to variant d2), a closed intermediate area is formed as the contaminated area when the safety cover is used to sheath the protective cover thereby closing the sheathing. Where the technical term sealing is used, this includes the production of peelable closure parts.

The subject matter of the invention is also a device for connecting a protective cover to a safety cover in a manner sealed against the environment, in particular for performing the method according to the invention. Advantageous features of the invention are provided.

A device according to the invention for sealing a protective cover to a safety cover against the environment comprises a dispensing device for a sealable film material which, dispensed as a film tube, comprises a passage for a transfer from a contaminated area into an uncontaminated area using a protective cover. The at least partially flexible safety cover hermetically seals the contaminated area from the uncontaminated area. At least one sealing device produces at least one preferably peelable film connection between layered sheeting parts of the safety cover and the relevant protective cover. One end of the protective cover, during transfer from the contaminated area to the uncontaminated area in a docking area, penetrates into a receiving end of the safety cover.

Advantageously, the safety cover is designed in the manner of a film tube, the free end of which remains closed in the docking area before the passage opening is produced and after the protective cover is dispensed. The film tube, while enclosing the passage and hermetically sealing the contaminated area from the uncontaminated area, is stored in a cassette, in particular stacked or rolled, to permit a continuous tube removal for several transfer operations of protective covers.

The protective cover is preferably designed to be peelable at least at its penetrating end having layered sheeting parts. The sheetings, which have been sealed against each other in this respect, are then pulled away from each other to open the passage opening.

A coverall for the transfer of a person sealed against the environment can be formed by the protective cover. After pulling the at least one peelable sheeting or its sheeting parts apart, the coverall can be put on or taken off by opening the passage opening.

Particularly advantageously, the closed sheeting is rolled up and stored in a preferably closable breast pocket of the coverall after the coverall has been put on and the associated passage opening has been closed by placing the peelable sheeting or parts of the sheeting against each other to form the penetrating end of the protective cover.

For an environmentally sealed transfer process of objects contained in a protective cover, the docking area can be installed in front of a manipulator room, in which work can be performed, preferably from the outside wearing gloves. The docking area is separated from the manipulator room by an airlock.

With particular advantage the docking area in front of the manipulator room can be designed as an airlock chamber, in conjunction with the cassette for the film tube and at least one sealing device.

Advantageously, the individual sealing device can be formed by two sealing jaws, which can be moved against each other and which preferably simultaneously permit a fusing or sealing of the film material. In addition to the formed joining seam, simultaneously the sealing jaws may perform a cutting or severing of the film material.

Other objects, advantages and salient features of the present invention will become apparent from the following detailed description, which, taken in conjunction with the drawings, discloses preferred embodiments of the present invention.

BRIEF DESCRIPTION OF THE DRAWINGS

Referring to the drawings that form a part of this disclosure.

DETAILED DESCRIPTION OF THE INVENTION

Figure 1:
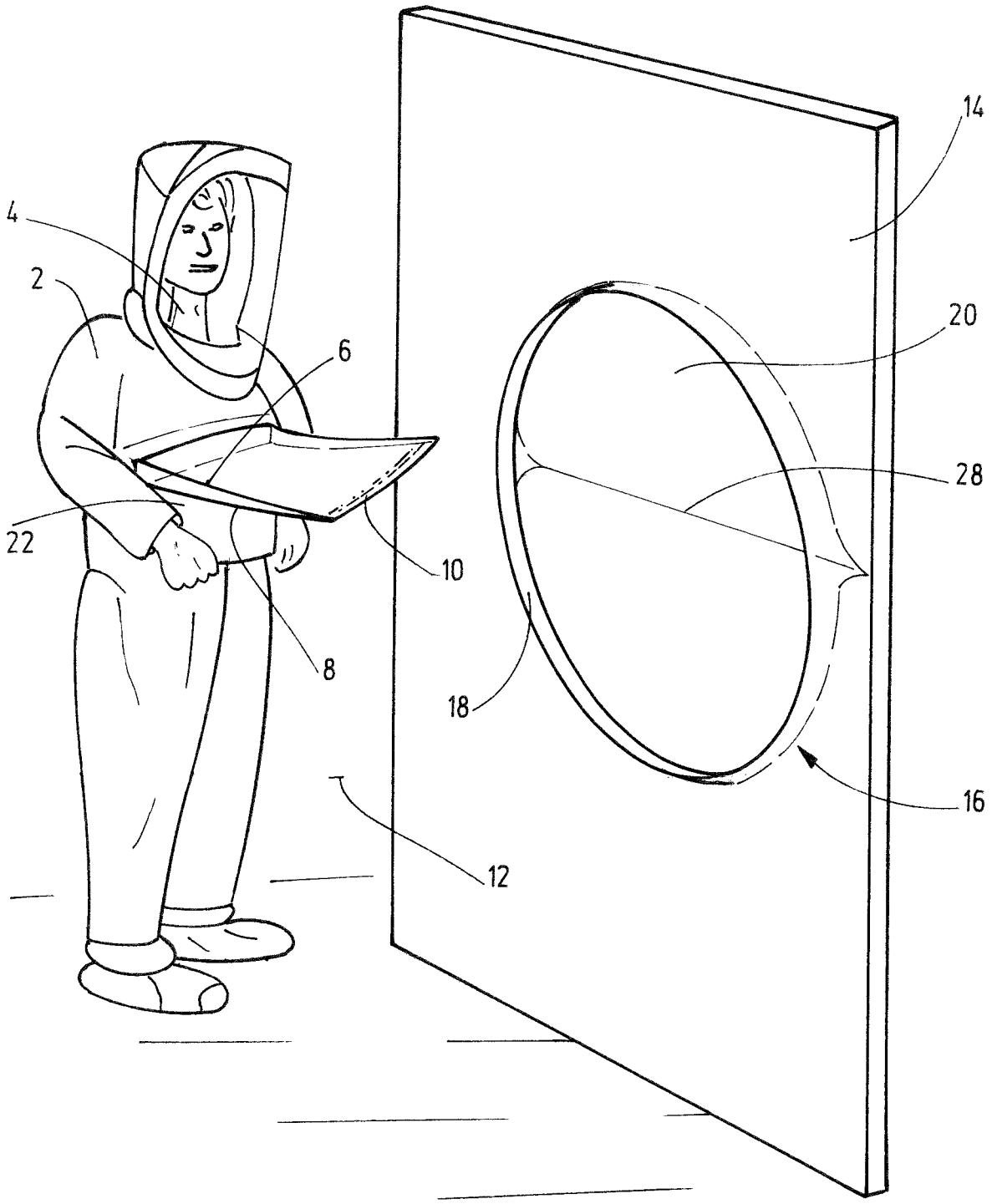
FIG. 1 is a highly schematically simplified and sketched perspective view of a protective cover in the form of a coverall and a part of the outer wall of a protective space having a docking area for the protective cover located thereon.

With reference to FIGS. 1 to 11, the invention is illustrated based on examples in which a protective cover 2, in the form of a coverall, is formed from sealable sheetings. The protective cover 2 forming the coverall has a passage opening to be put on or taken off by a person 4, which passage opening is formed by two layered sheeting parts 6 and 8. Sheeting parts 6 and 8 are sealed in a peelable manner at the free end 10 such that they can be pulled apart to open the passage opening. When the passage opening is closed, hermetic enclosure protects the person 4 against external contamination. A docking area 16 having a passageway 18 is provided for the safe transfer of the person 4, who is located in a contaminated area 12 in FIG. 1, such as the infection or quarantine station of a hospital, to a protective space protected against contamination, of which only part of its outer wall 14 is shown in FIG. 1.

Figure 2:
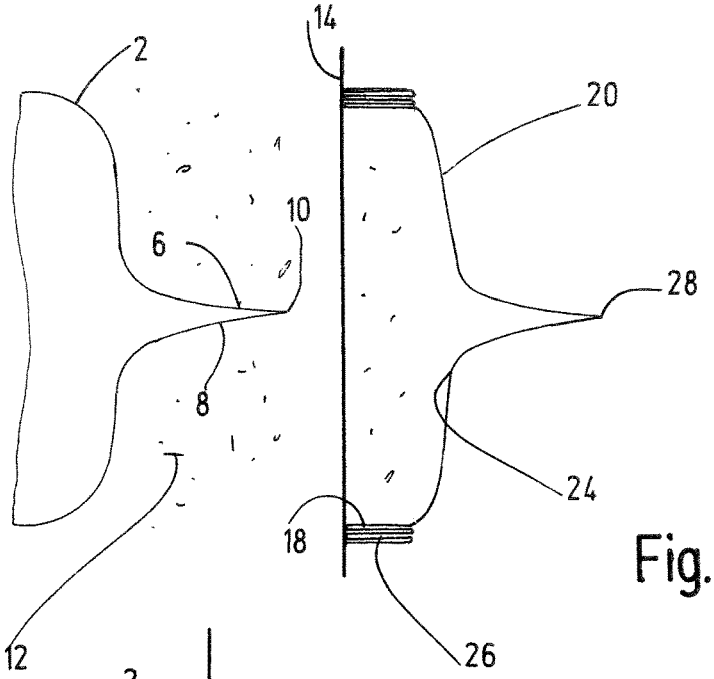
FIG. 2 a functional side view sketch, which is even more simplified than FIG. 1, of the docking area of the outer wall having a transfer passage closed by the safety cover and a connecting end of the protective cover before it is joined to the receiving end of the safety cover.
Figure 3:
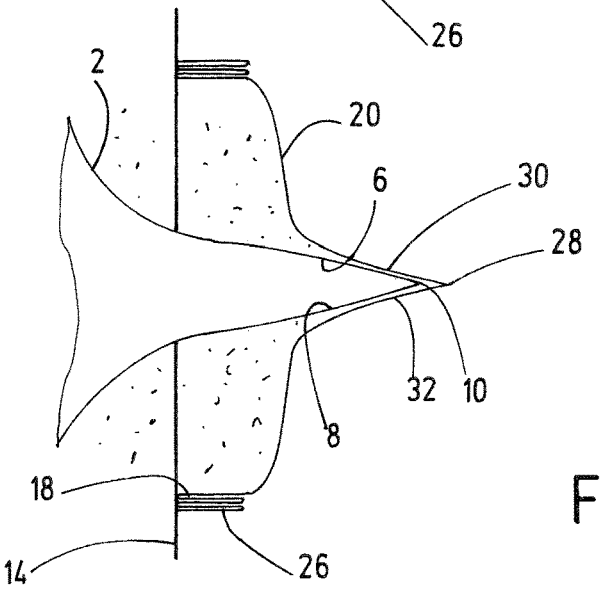
FIG. 3 is a side view sketch of the docking area of FIG. 2, wherein the joined state of the ends of both covers is shown.
Figure 4:
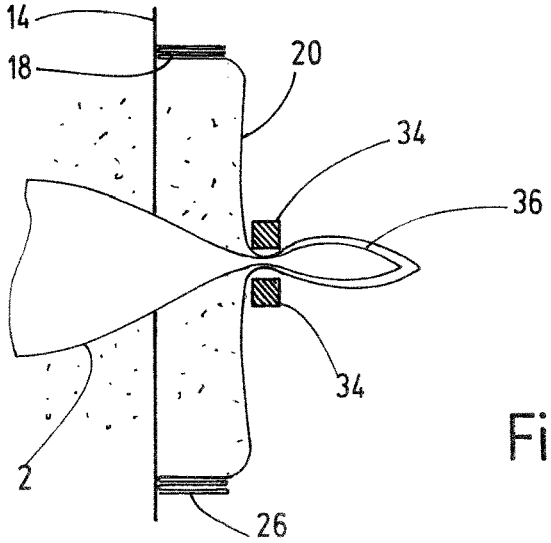
FIGS. 4 and 5 are side view sketches of the docking area of FIG. 2 wherein the state of joining and closing of the joined ends of the covers by cut-off sealing and the cutting off of protruding ends of the covers, respectively, are shown.
Figure 5:
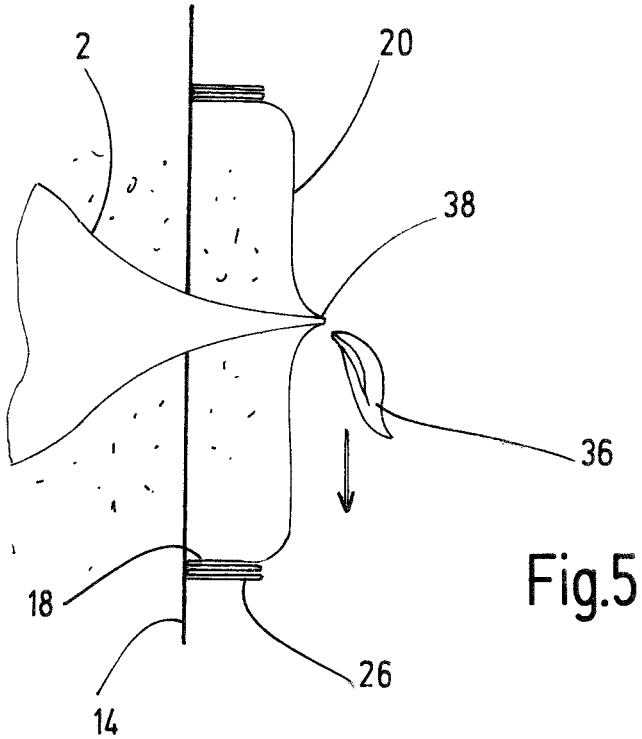

FIGS. 1 to 5 illustrate the docking process and the creation of a connection between the protective cover 2 and a safety cover 20 sealed against the environment. Before docking, the sheeting parts 6 and 8, which form the peelable sealed passage opening 10 of the coverall at the free end 10, are folded and rolled up in a sealable breast pocket 22 of the coverall. From pocket 22, sheeting parts 6 and 8 can be pulled out for the docking procedure and brought into the position shown in FIGS. 1 and 2. The safety cover 20 is formed of a tube of sealable film material. The closed bottom 24 of safety cover 20 forms a hermetic seal of a passage 18, which is intended for the transfer in the outer wall 14. The protective cover 2 then separates the contaminated area 12 from an uncontaminated area. The open end of the tube forming the safety cover 20, opposite from the bottom 24, is stored, when rolled up, in a cassette 26 surrounding the edge of the transfer passage 18 of the outer wall 14. The protective cover 2 in FIG. 2 can be pulled out to the right from the hose store and is available from the store for several transfer operations. FIG. 2 shows that the safety cover 20 is pulled slightly to the right for the docking and connecting procedure such that the penetrating end 10 of the protective cover 2 can be accommodated in a receiving end 28 of the safety cover 20 as shown in FIG. 3, where the adjacent sheeting sections 6 and 8 of the protective cover 2 are situated between sheeting sections 30 and 32 of the safety cover 20. FIG. 4 shows the subsequent sealing of the adjacent sheeting parts. This sealing is done by cutting and sealing using movable sealing jaws 34. As shown in FIGS. 4 and 5, a protruding end piece 36 is severed and disposed of. Sealing bars known as sealing jaws 34 are provided for cut and seal processes, which sealing bars extend over the entire width of the hoses of the covers 2, 20 to be sealed. Such sealing bars for electrical heat impulse sealing are available, for instance, from JOKE Folienschweißtechnik GmbH, Asselborner Weg 14 bis 16, DE 51429 Bergisch Gladbach.

Figure 6:
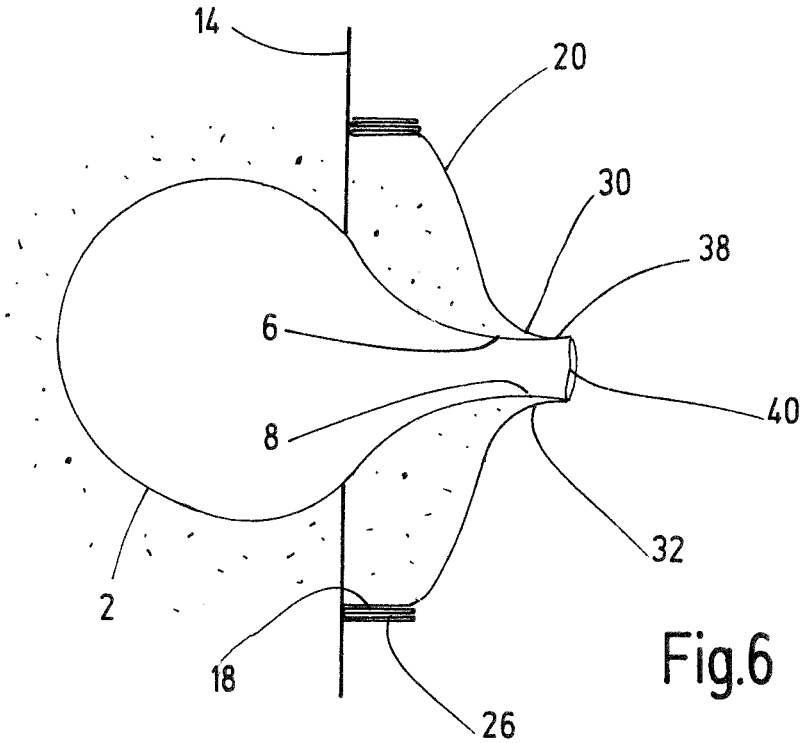
FIG. 6 is a side view sketched of the docking area of FIG. 2 of the process of forming an opening between the joined ends of the covers.
Figure 7:
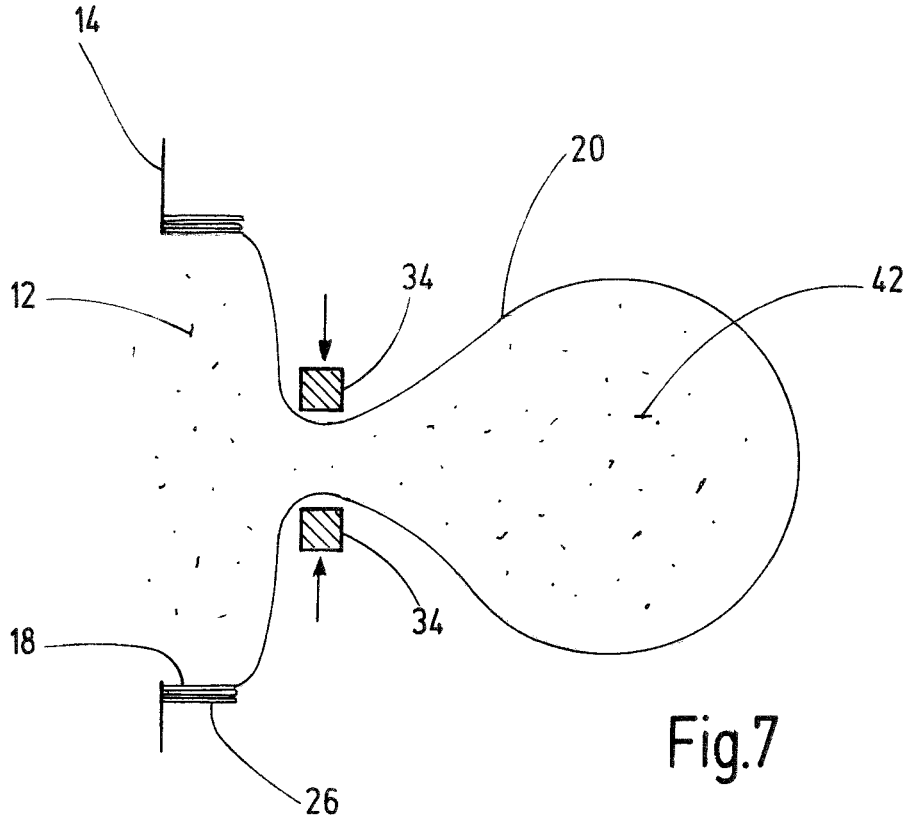
FIG. 7 is a side view sketch of the docking area of FIG. 2 of the state after the protective cover has been inverted and before the opening is closed.
Figure 8:
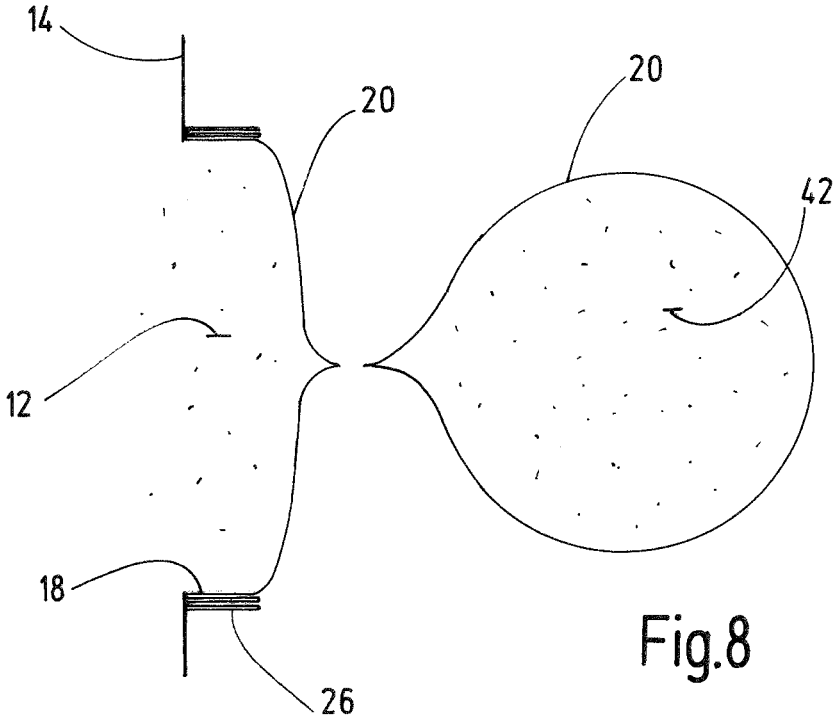
FIG. 8 is a side view sketch of the docking area of FIG. 7 with a severed, closed protective cover.

FIG. 6 illustrates the subsequent stage of forming a passage opening 40 by peeling, i.e. lifting the sheeting parts 6 and 8 from each other. When the opening 40 has been formed, the protective cover 2 can be inverted across the opening 40, such that the inside of the protective cover 2 is turned inside out and in that way the contents of the protective cover 2, i.e. when the protective cover 2 is formed as a coverall, the person 4, is transferred out to the clean side behind the outer wall 14. As FIGS. 7 and 8 show, the inverted protective cover 2 is closed and severed from the safety cover 20 by a cut and seal process, as it is also performed in FIG. 4 using the sealing jaws 34. While in FIGS. 4 and 5 the end piece 36 is produced as severed waste, the closed protective cover 2 with the contaminated interior 42 is now severed for waste disposal, see FIG. 8. The person to be protected against contamination can, in reverse order from the described, basically also enter a contaminated room via the corresponding passage opening 18 into the coverall and detach from the docking area 16 accordingly. However, it is also possible to put on the coverall in a normal airlock area before entering the contaminated room via a separate airlock entrance.

Figure 9:
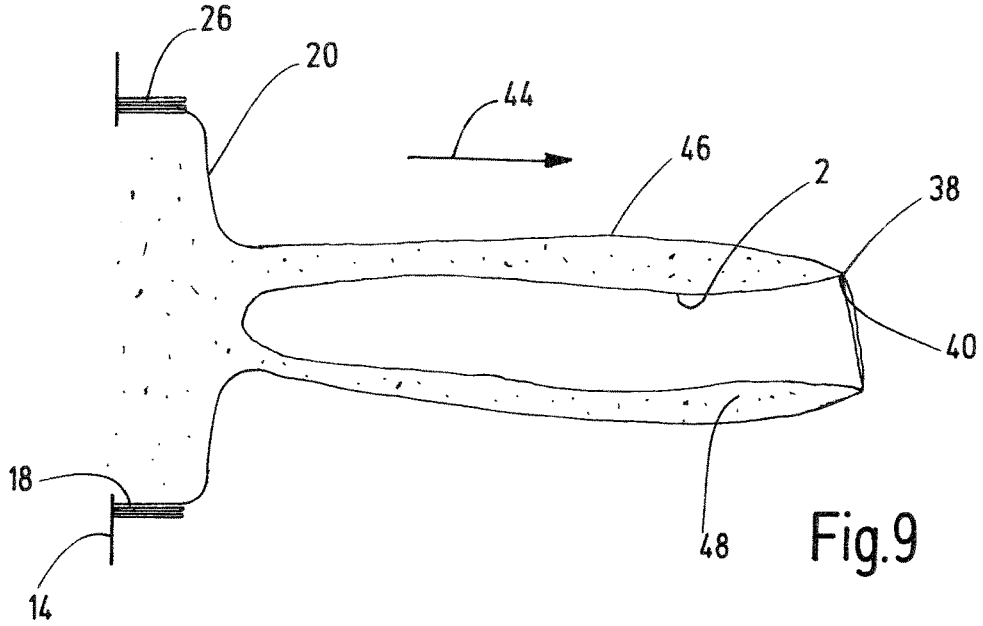
FIG. 9 is a side view sketch of the docking area with the open protective cover sheathed in the safety cover.
Figure 10:
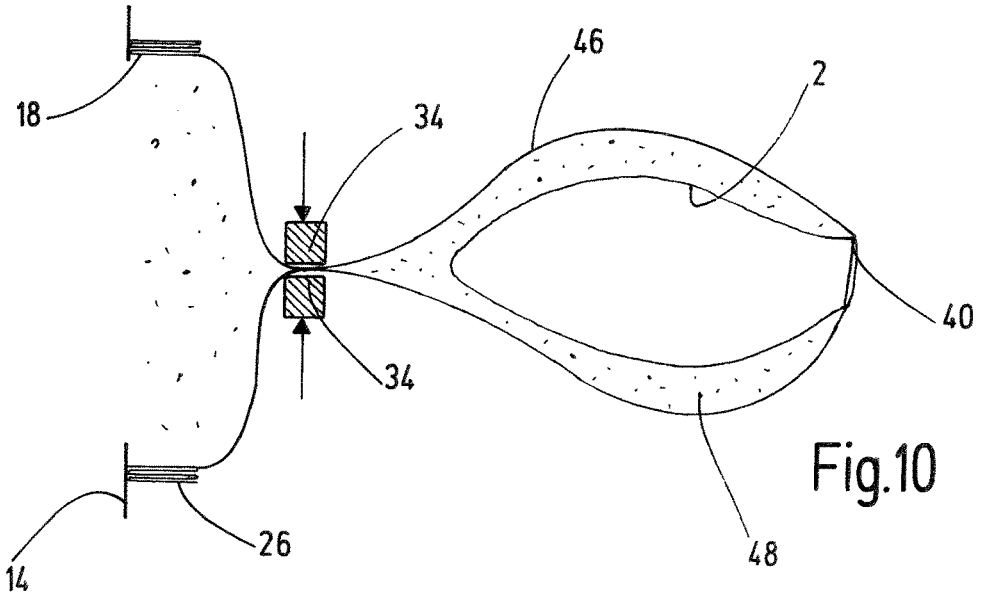
FIG. 10 is a side view sketch of the docking area of FIG. 9 with a safety cover closed by cutting and sealing.
Figure 11:
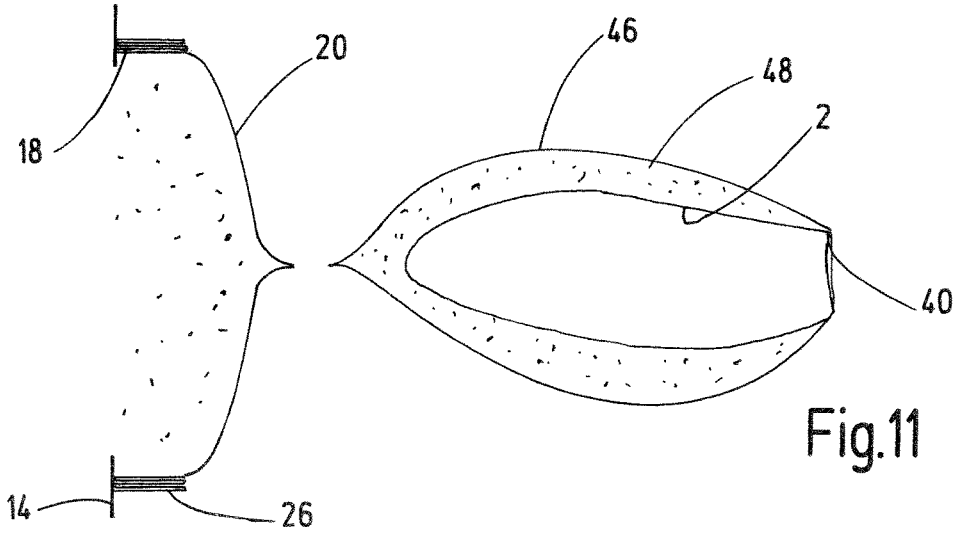
FIG. 11 is a side view sketch of the docking area with the cut protective cover sheathed by the safety cover.

FIGS. 9 to 11 illustrate a variant in which, starting from the state of FIG. 6 where the opening 40 is formed, the protective cover 2 is not turned over, but is pulled through the transfer passage 18 of the outer wall 14 in the direction indicated by the arrow 44 in FIG. 9. The safety cover 20 connected to the protective cover 2 at the sealing point 38 is pulled out as well, and thus, forms a sheathing 46 of the protective cover 2. By closing the sheathing 46 by the sealing jaws 34 performing a cut and seal process, a contaminated intermediate space 48 is formed between the protective cover 2 and the sheathing 46 as a closed area, as shown in FIGS. 10 and 11, such that the separate, closed unit can be disposed of as shown in FIG. 11. The coverall is then taken off via the opening left open at the front (not to scale).

Figure 12:
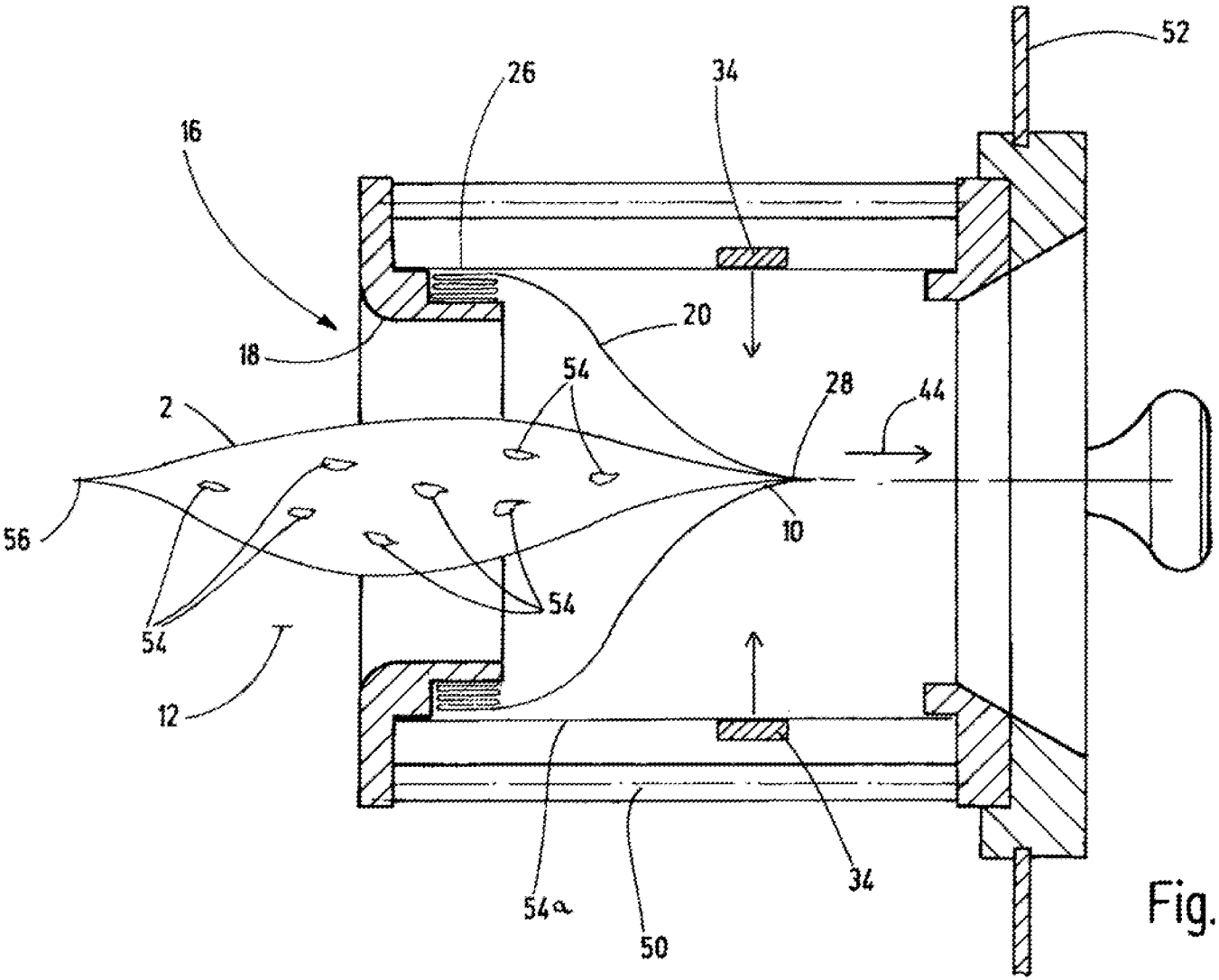
FIG. 12 is schematically simplified, side view in section of an airlock chamber forming a docking area installed in front of a manipulator room.

FIG. 12 shows an example, in which the docking area 16 is formed by an airlock chamber 50, which is installed in front of a manipulator room (not shown), of which only a partition 52 between the airlock chamber and the manipulator room is indicated. In the manipulator room, which forms a clean room or sterile room, located to the right of the partition 52 in FIG. 12, work can be performed from the outside by slipping into gloves as per usual. FIG. 12 shows the docking procedure for the contamination-free transfer of the protective cover 2 from a contaminated area 12 through the airlock chamber 50 into the manipulator room. Here the protective cover 2 forms the hermetically sealed packaging for objects 54. In the same way as shown in FIG. 3, the peelably sealed penetrating end 10 of the protective cover 2 is inserted into the receiving end 28 of the safety cover 20 and is peelably sealed in the same way as shown in FIG. 4 by the sealing jaws 34. Because the sealing point is located within the enclosed area of the airlock chamber 50, which is connected to the manipulator room as the clean room of the airlock chamber 50, the sealing jaws 34 are arranged outside an elastically yielding partition wall 54*a* enclosing this clean room. The partition wall 54*a* wall is formed, for instance, by a tubular silicone layer, the flexibility of which permits the sealing jaws 34 to be moved towards each other from the outside for the purpose of cutting and sealing. After the sealing process, in which the adjacent sheeting parts of the protective cover 2 and the safety cover 20 are peelably sealed in the same way as shown in FIG. 4, the protective cover 2 is pulled through in the direction of the arrow 44 and thereby sheathed by the safety cover 20. As shown in FIG. 9 during the corresponding pulling-through process of the protective cover 2, the protective cover is provided with the sheathing 46. At the end 56, which is pulled into the airlock chamber 50 in the direction of the arrow 44, the same cutting and sealing operation as shown in FIGS. 10 and 11 can now be performed for the sheathed unit. Because the contaminated interspace 48 located on the outside of the protective cover 2 is hermetically sealed by the sheathing 46, the objects 54 in the manipulator chamber can be removed after the passage opening 40 has been formed by peeling the sealing point at the penetrating and receiving ends 10 and 28, respectively.

While various embodiments have been chosen to illustrate the invention, it will be understood by those skilled in the art that various changes and modifications can be made therein without departing from the scope of the invention as defined in the claims.

The invention claimed is:

1. A method for connecting an at least partially flexible protective cover, forming a barrier between a contaminated area and an uncontaminated area, to an at least partially flexible safety cover (20) sealed against an environment, the protective and safety covers being formed at least partially of a film material sealable to produce a one film joint, the method comprising the following method steps:

a) arranging a receiving end of the safety cover opposite from an end of the protective cover penetrating into the end of the safety cover in a docking area;

b) bringing the ends of the protective safety covers together in the docking area;

c) severing the ends and sealing adjacent film parts of the protective and safety covers along a joint seal delimiting the joint seal after a passage opening is opened; and d1) transferring the protective cover out of the contaminated area by inverting the protective cover over the opening such that an inside of the protective cover is turned out and then severing the protective cover from the safety cover and closing the opening; or d2) transferring the protective cover from the contaminated area by sheathing the protective cover with the safety cover as the protective cover is pulled through a passage and subsequent severing of the protective and safety covers from the safety cover and closing the sheathing; or d3) pulling the protective cover back into the contaminated area and then sealing the ends shut to sever the safety cover by forming a further sealed joint between adjacent film parts.

2. The method according to claim 1, wherein a contaminated area is enclosed in an interior of the inverted protective cover while closing the passage opening.

3. The method according to claim 1, wherein a closed intermediate space is formed as a contaminated area when the safety cover is used to sheath the protective cover thereby closing the sheathing.

4. The method according to claim 1, wherein the safety cover is designed in the manner of a film tube, a free end of the film tube remains closed in the docking area before the passage opening is produced and after the protective cover is dispensed.

5. The method according to claim 1, wherein the protective cover is peelable at least at a penetrating end thereof having layered sheeting parts lying on top of each other such that in severing the ends, the safety parts are pulled away from each other to open the passage opening.

6. The method according to claim 1, wherein a coverall for the transfer of a person sealed against the environment can be formed by the protective cover, and after pulling the at least one peelable sheeting or sheeting parts apart, the coverall can be put on or taken off by opening the passage opening.

7. The method according to claim 6, wherein the closed sheeting is rolled up and stored in a closable pocket of the coverall after the coverall has been put on and the associated passage opening has been closed by placing the peelable sheeting or the sheeting parts against each other to form the penetrating end of the protective cover.

8. A device for connecting an at least partially flexible protective cover, forming a barrier between a contaminated area and an uncontaminated area, to an at least partially flexible safety cover sealed against an environment, the device comprising:

a docking area;

a dispensing cassette storing sealable film material and being capable of dispensing the sealable film material as a continuous flexible film tube forming safety covers each with a closed end and with an open receiving end receiving a penetrating end of the protective cover in performing multiple transfer operations of multiple protective covers and including a passage capable of transferring the protective cover from the contaminated area into the uncontaminated area, the dispensing cassette being in the docking area; and a sealer in the docking area hermetically forming a seal between layer sheeting parts of the safety cover and the protective cover at ends of the safety cover and the protective cover during transfer through the passage from the contaminated area to the uncontaminated area in the docking area.

9. The device of claim 8 wherein the dispensing cassette has stacked or rolled film material.

10. The device according to claim 8 wherein the sealer comprises first and second sealing jaws movable toward and away from one another and simultaneously fusing and cutting of the film material.

11. The device according to claim 8 wherein the sealer is in the uncontaminated area.

12. The device according to claim 10 wherein the sealer is in an airlock chamber separated from an airlock passage by an elastically flexible partition.

13. The device according to claim 12 wherein the flexible partition is has a silicone layer.

14. A device according to claim 8 wherein the docking area is connected in front of a manipulator room in which work can be performed and is separated from the manipulator room by an airlock.

15. The device according to claim 8 wherein the dispensing cassette is on an outer wall of a protective space or its part of an airlock chamber.

16. The device according to claim 8 wherein the docking area is in front of a manipulator room being an airlock chamber.

* * * * *